US005235761A

United States Patent [19]

Chang

[11] Patent Number: 5,235,761

[45] Date of Patent: Aug. 17, 1993

[54] MULTIPLE-PURPOSE ELASTIC SHOE

[76] Inventor: Che-Yuan Chang, c/o Hung Hsing Patent Service Center, P. O. Box 55-1670, Taipei, Taiwan, (10477)

[21] Appl. No.: 771,128

[22] Filed: Oct. 3, 1991

[51] Int. Cl.[5] ..... A43B 7/06; A43B 13/18; A43B 23/00

[52] U.S. Cl. ..... 36/3 R; 36/3 B; 36/28; 36/137; 36/139

[58] Field of Search ..... 36/3 R, 3 B, 27, 28, 36/29, 137, 139

[56] References Cited

U.S. PATENT DOCUMENTS

| | | | |
|---|---|---|---|
| 819,449 | 5/1906 | Otterstedt | 36/3 B |
| 1,380,879 | 6/1921 | Young | 36/28 |
| 1,870,114 | 8/1932 | Heller | 36/3 R |
| 2,720,041 | 10/1955 | Kajtar | 36/3 B |
| 2,751,692 | 6/1956 | Cortina | 36/3 B |
| 4,128,861 | 12/1978 | Pelengaris | 36/137 |
| 4,257,176 | 3/1981 | Hartung et al. | 36/3 B |
| 4,364,186 | 12/1982 | Fukuoka | 36/3 B |
| 4,485,568 | 12/1984 | Landi et al. | 36/3 B |
| 4,771,556 | 9/1988 | Kim | 36/139 |
| 4,845,863 | 7/1989 | Yung-Mao | 36/30 R |

FOREIGN PATENT DOCUMENTS

| | | | |
|---|---|---|---|
| 0121026 | 10/1984 | European Pat. Off. | 36/137 |
| 0335467 | 10/1989 | European Pat. Off. | 36/137 |
| 0331247 | 10/1935 | Italy | 36/3 R |

*Primary Examiner*—Steven N. Meyers
*Assistant Examiner*—M. D. Patterson

[57] ABSTRACT

A shoe includes an outsole having an elastic jacket formed on the outsole for exerting an elastic property of the shoe, a midsole made of or impregnated with medical compositions for diffusing medicine vapors onto a wearer's foot for treating the wearer's disease, an insole formed with beehive polygonal protrusions for massaging a wearer's foot, an illuminator and a musical or alarm device formed in the outsole for optical decorative and musical entertaining or emergency warning purposes.

2 Claims, 3 Drawing Sheets

MULTIPLE-PURPOSE ELASTIC SHOE

BACKGROUND OF THE INVENTION

A conventional shoe may incorporate a plurality of springs in a sole for enriching an elasticity of the shoe for its comfortable wearing. However, each helical spring is not jacketed with any cylindrical sleeve so that the spring may be easily twisted or deformed to form internal stress in partial springs causing an uncomfortable wearing of the shoe.

Even an insole of a shoe may be formed with a plurality of protrusions thereon for massaging use. However, each protrusion is formed with a top tip portion, easily sticking a wearer's foot to cause his or her pain.

The present inventor has found the drawbacks of a conventional shoe and invented the present elastic shoe having multiple purposes.

SUMMARY OF THE INVENTION

The object of the present invention is to provide a shoe including an outsole having an elastic jacket formed on the outsole for exerting an elastic property of the shoe, a midsole made of or impregnated with medical compositions for diffusing medicine vapors onto a wearer's foot for treating the wearer's disease, an insole formed with beehive polygonal protrusions for massaging a wearer's foot, an illuminator and a musical or alarm device formed in the outsole for optical decorative and musical entertaining or emergency warning purposes.

DETAILED DESCRIPTION

Figure 1:
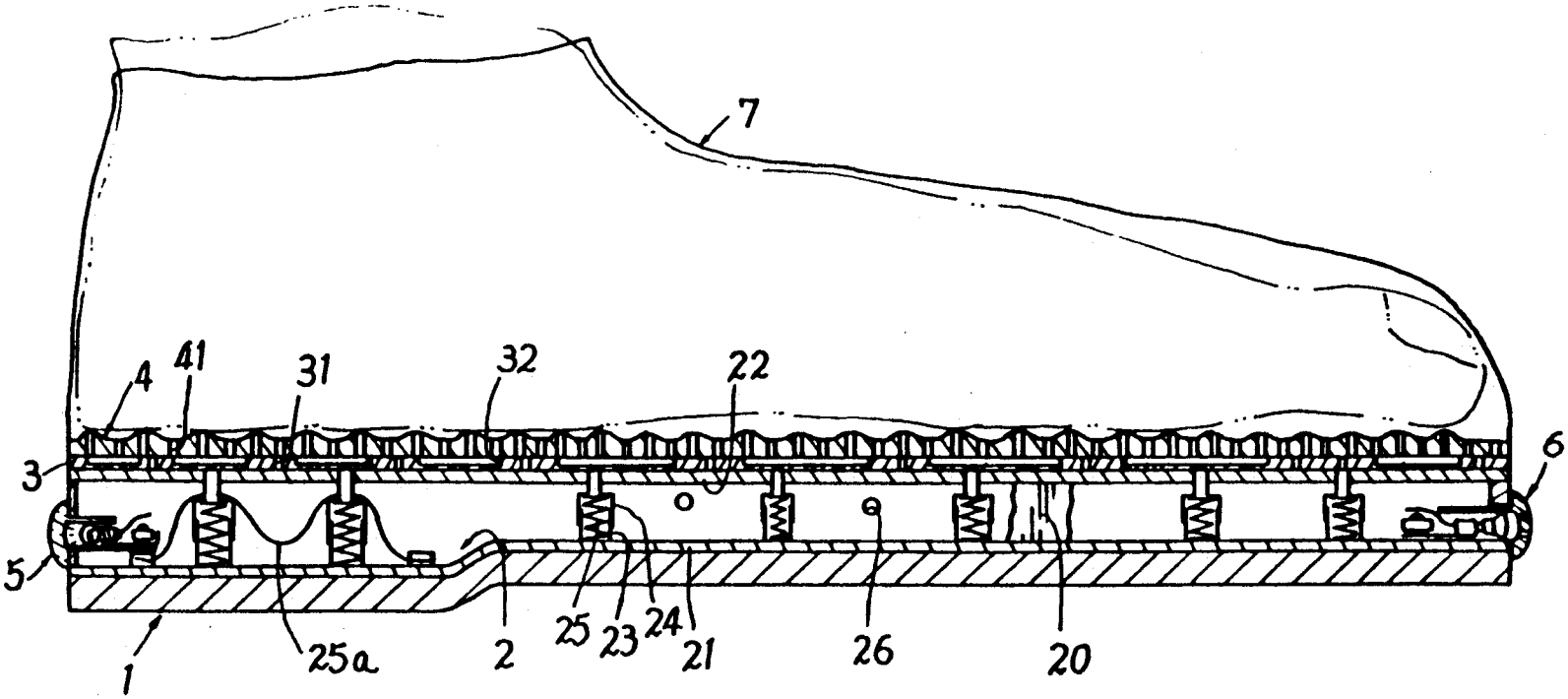
FIG. 1 is a sectional drawing of the present invention.

As shown in FIGS. 1-7, the present invention comprises: an outsole 1, an elastic jacket 2, a perforated midsole 3, a perforated insole 4, an illuminating means 5, a sounding means 6 and an upper 7.

The elastic jacket 2 is embedded in or secured on the outsole 1 and includes: a lower substrate 21 adjacent to a bottom portion of said outsole 1, an upper layer 22 secured with the midsole 3, a side cover 20 connected between the upper layer 22 and the lower substrate 21 circumferentially disposed around a circumferential side portion of the jacket 2, a plurality of elastic pumping means 2a formed between the lower substrate 21 and the upper layer 22 resiliently retaining the substrate 21 and the upper layer 22 and operatively pumping air upwardly through the perforated midsole 3, the perforated insole 4 for ventilating a wearer's foot, and a plurality of ventilating holes 26 formed in the side cover 20 communicated with the atmosphere.

The side cover 20 may be made of flexible, transparent materials for visual purpose of the illuminating means 5 formed in the outsole 1 through a transparent side cover 20.

Figure 6:
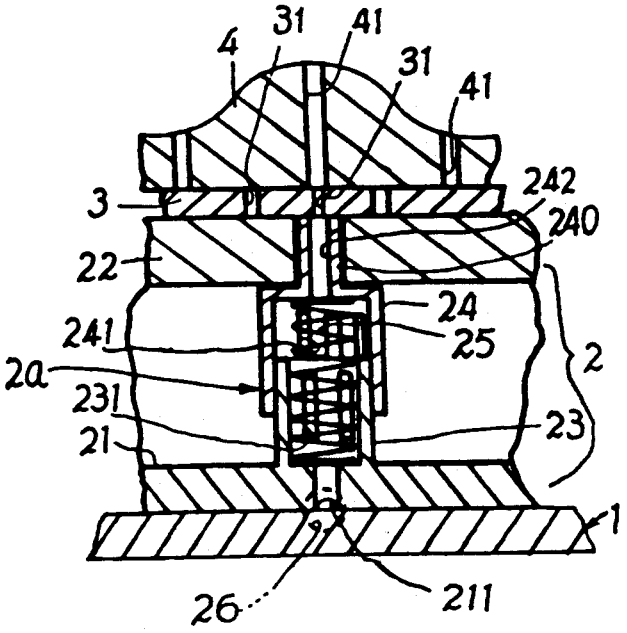
FIG. 6 is a partial sectional drawing of the present invention including an elastic pumping means.
Figure 7:
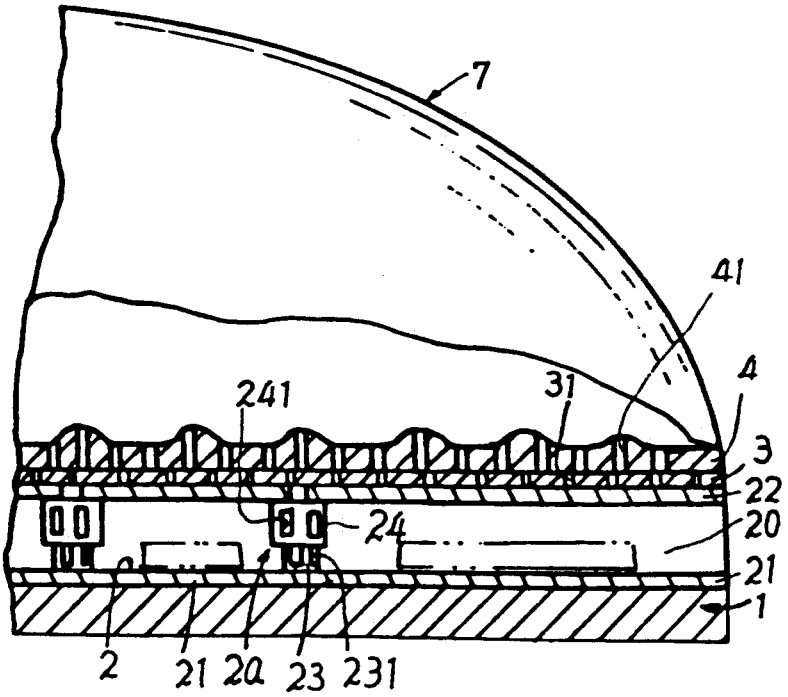
FIG. 7 is a partial cut-away illustration of the present invention.

Each elastic pumping means 2a as shown in FIGS. 1, 6 and 7 includes: a lower cylinder 23 formed on the lower substrate 21 having a plurality of ventilating holes 231 formed in the lower cylinder 23, an upper cylinder 24 secured to the upper layer 22 slidably jacketed on the lower cylinder 23 having a plurality of ventilating holes 241 formed in the upper cylinder 24, a tensioning spring 25 retained in the upper and lower cylinders 24, 23, and an upper tube 240 protruding upwardly from the upper cylinder 24 through the upper layer 22 having a central hole 242 formed in the upper tube 240 communicating the midsole 3 and an interior in the jacket 2.

As shown in FIG. 1, an arcuate spring plate 25a is provided in the elastic jacket 2 at a heel position of a shoe for reinforcing the elastic pumping means 2a, the spring plate 25a having its two opposite ends slidably held on the lower substrate.

As shown in FIG. 6, a bottom opening 211 may be formed in the lower substrate 21 for communicating an interior in the lower cylinder 23 and a ventilating hole 26 formed in the outsole 1.

The elastic pumping means 2a may include an air inlet check valve (not shown) formed in the lower cylinder 23 allowing a single-way air inlet into the cylinders 23, 24 and an air outlet check valve (not shown) formed at the upper tube 240 of the upper cylinder 24 allowing a single-way air outlet from the cylinders 23, 24.

Even the cylinders 23, 24 of the elastic pumping means 2a formed with holes 231, 241 therein may influence a volumetric rate of an upwardly flowing air, it is however not so critical because such holes 231, 241 may also serve as exchange holes for sucking fresh (atmosphere) air through the holes 26 into the cylinders, or discharging partial waste air outwardly. This invention is provided for a comfortable ventilation of a wearer's foot, not for serving a precise "pump" for engineering purpose. The spring 25 is compressed or released within the cylinders 23, 24 to thereby ensure a uniform operation and prevent an unexpected twisting or deformed drawbacks as found in conventional spring-loaded shoes or soles.

Figure 3:
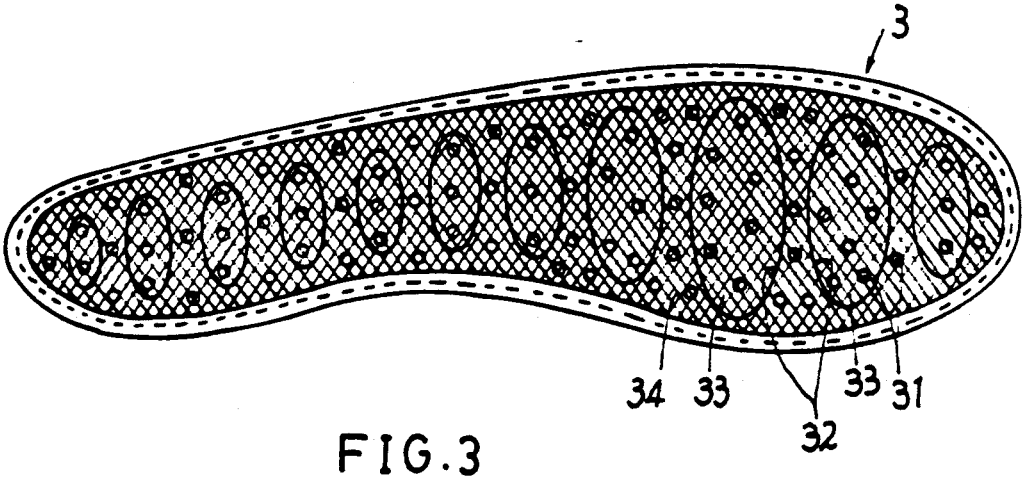
FIG. 3 is a top view of a midsole of the present invention.

The midsole 3 as shown in FIGS. 1, 3 is formed with a plurality of ventilating perforations 31 therein for fluidically communicating the jacket 2 and the insole 4, and formed with at least a socket 32 for filling medicine 33 in the socket 32, and an air-penetratable screen 34 covering the midsole 3 for preventing loss of the medicine 33.

The midsole 3 may be integrally formed by incorporating, absorbing or lading medicine onto fibrous and absorbent materials to form a foot shape pad embedded in between the insole 4 and the elastic jacket 2.

The medicine 33 used in the midsole 3 may be selected from a Chinese medicine which, for instance, may be absorbed into nerve endings through sweat glands in a wearer's foot for treating some nerve diseases; or selected from a chemical or pharmaceutical compositions such as for curing an athlete's foot or other diseases. The medicine may be added, impregnated, filled into a porous absorbent or carrier to be filled in the socket 32 of the midsole 3. The formulation of medicine, the size and numbers of the sockets 32 and the methods for making the midsole 3 are not limited in this invention.

Figure 2:
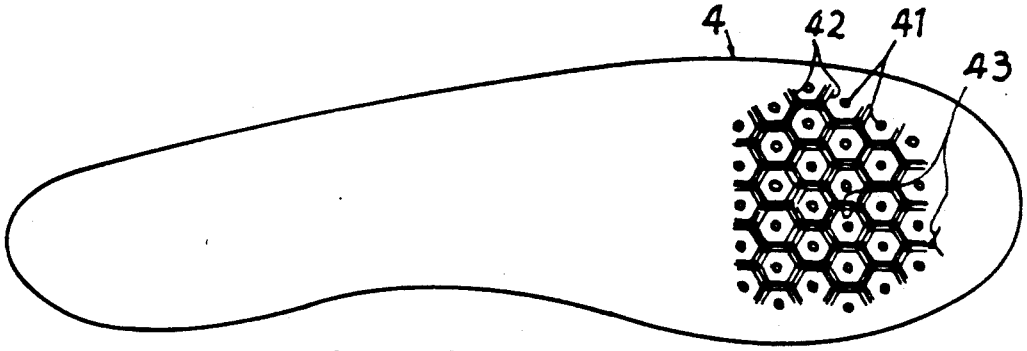
FIG. 2 is a top view of an insole of the present invention.

The insole 4 as shown in FIG. 2, 1 includes: a plurality of ventilating perforations 41 formed in the insole 4 communicated with perforations 31 of the midsole 3, a plurality of polygonal protrusions 42 convexly formed on the insole 4, and a plurality of polygonal grooves 43 recessed in the insole 4, the protrusions 42 and the grooves 43 generally forming a beehive-like structure as shown in FIG. 2.

Since each of the protrusions 42 is formed as polygonal shape, not an acute tip top to be easily stuck by a wearer's foot, the insole 4 of this invention can be worn for massaging the wearer's foot by the convex protrusions 42 and recessed grooves 43, but being not painful, to be superior to a conventional insole with acute protrusions.

The insole 4 and the midsole 3 may be combinably or integrally formed for simplifying the production of the present invention.

Figure 4:
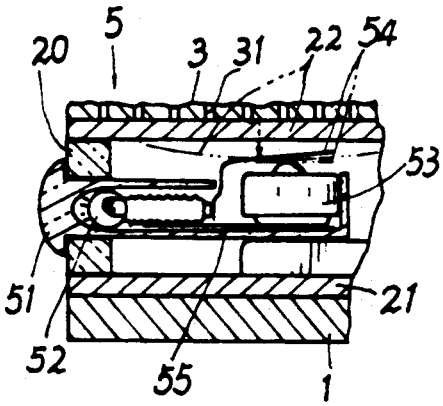
FIG. 4 is an illustration of an illuminating means of the present invention.

The illuminating means 5 as shown in FIG. 4 includes: a cassette casing 51 formed or plugged in a transparent side cover 20 of the elastic jacket 2 on the outsole 1, an illuminator 52 held in the casing 1 selected from bulb and light emitting diodes powered by a power source of battery 53 stored in the casing 51 and electrically connected with the illuminator 52 by two wires 54, 55 having one wire 54 normally separated from one pole of the battery 53 for switching off the power source and operatively contacted with the pole of battery 53 to close two poles of the power source for powering the illuminator 52 so that upon a treadling of a shoe of the present invention, the illuminator 52 will be lit by compressing and depressing the jacket 2 to close the two poles of the power source and upon a releasing of the shoe above a ground 1 the illuminator 52 will be off, thereby causing a flashing illumination.

A plurality of illuminators 52 may be connected in series to form an "optical strap" which may be disposed around a contour of the shoe of the present invention for entertaining, interesting or decorative purposes.

Figure 5:
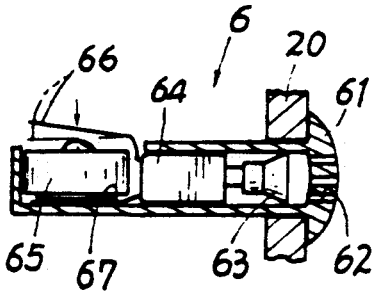
FIG. 5 shows a sounding means of the present invention.

The sounding means 6 as shown in FIG. 5 includes: a cassette casing 61 having sound-transmission holes 62 formed in the casing 61 plugged or formed in the side cover 20 of the jacket 2 on the outsole 1, a speaker 63 connected with a printed circuit board 64 prerecorded with music melodies or warning alarm stored in the casing 61, and a power source 65 of a battery held in the casing 61 electrically connected with the printed circuit board 64 by two wires 66, 67 of which one wire 66 is normally separated from one pole 66 of the power source 65 for switching off the power source and operatively contacted with the pole 66 of the power source 65 for closing two poles of the power source and for triggering the printed circuit board 64 for producing a musical sounding through the speaker 63.

The audio and visual means of the present invention may be used in a Disco dancing ground or may be used as a safety traffic warning device such as worn by a jogger in a night or dark time.

An additional electric selector switch (not shown) may be provided in the illuminating means 5 for selectively switching on, off or a flashing operation of the illuminators 52. For safety alarm purpose, an alarm sounding may be prerecorded in the sounding means 6 and a selector switch may be further provided to actuate the alarm in case of emergency for a predetermined period which should be well design, not be easily broken by an intruder or a robber.

I claim:

1. A shoe comprising:

an outsole formed on a bottom portion of a shoe having an upper formed thereon;

an elastic jacket embedded in the outsole including: a lower substrate adjacent to a bottom portion of said outsole, an upper layer secured with a perforated midsole positioned above the elastic jacket, a side cover connected between the upper layer and the lower substrate circumferentially disposed around a circumferential side portion of the elastic jacket, a plurality of elastic pumping means formed between the lower substrate and the upper layer resiliently expandably retaining the lower substrate and the upper layer and operatively depressed for pumping air upwardly through the perforated midsole, a perforated insole formed above the midsole for ventilating a wearer's foot, and a plurality of atmospheric ventilating holes formed in the side cover communicating the atmosphere;

an illuminating means and a sounding means formed in said elastic jacket in said outsole, the improvement which comprises:

each said elastic pumping means including: a lower cylinder formed on the lower substrate having a plurality of ventilating holes formed in the lower cylinder, an upper cylinder secured to the upper layer slidably jacketed on the lower cylinder having a plurality of ventilating holes formed in the upper cylinder, a tensioning spring retained in the upper and lower cylinders and an upper tube protruding upwardly from the upper cylinder through the upper layer having a central hole formed in the upper tube communicating the midsole and an interior in the jacket.

2. A shoe according to claim 1, wherein an arcuate spring plate is provided in the elastic jacket at a heel position of a shoe for reinforcing the elastic pumping means, the spring plate having its two opposite ends slidably held on the lower substrate of said jacket.

* * * * *